United States Patent [19]

Bakay et al.

[11] Patent Number: 4,747,980

[45] Date of Patent: May 31, 1988

[54] COOLING APPARATUS

[75] Inventors: Árpád Bakay; György Bergmann; János Bódás; István Papp; Zoltán Szabó, all of Budapest, Hungary

[73] Assignee: Transelektro Magyar Villamossagi Kulkereskedelmi Vallalat, Budapest, Hungary

[21] Appl. No.: 920,708

[22] Filed: Oct. 17, 1986

[30] Foreign Application Priority Data

Oct. 24, 1985 [HU] Hungary ..... 4101/85

[51] Int. Cl.[4] ..... F28B 7/00

[52] U.S. Cl. ..... 261/129; 261/153; 261/139; 261/DIG. 11; 165/39; 165/108; 165/900

[58] Field of Search ..... 261/153, 129, 139, DIG. 11; 165/900, 39, 108

[56] References Cited

U.S. PATENT DOCUMENTS

| | | | |
|---|---|---|---|
| 3,384,165 | 5/1968 | Mathews | 165/900 |
| 3,776,306 | 12/1973 | Michel | 165/900 |
| 3,887,666 | 6/1975 | Heller et al. | 165/900 |
| 3,923,935 | 12/1975 | Cates | 261/DIG. 77 |
| 3,925,523 | 12/1975 | Cates | 261/DIG. 77 |
| 4,531,576 | 7/1985 | Kals | 165/900 |

FOREIGN PATENT DOCUMENTS

| | | | |
|---|---|---|---|
| 54-49403 | 4/1979 | Japan | 165/108 |
| 904959 | 9/1962 | United Kingdom | 165/108 |

*Primary Examiner*—Tim Miles

*Attorney, Agent, or Firm*—Handal & Morofsky

[57] ABSTRACT

In a cooling apparatus operated by ambient air and an agent to be cooled which can have solid state at atmospherical temperatures, a housing such as a cooling tower (100) with air inlets and air closure means at the air inlets and large surface heat exchangers (3) arranged within the cooling tower (100) at its air inlets and divided into groups or sectors being in parallel connection are provided, with which the agent is cooled by the air streaming through the large surface heat exchangers (3). At least one pre-heating heat exchanger (20) is arranged in the air space (29) of each sector of the large surface heat exchangers (3), and the pre-heating heat exchangers (20) are in parallel connection with the large surface heat exchangers (3) of each sector.

10 Claims, 5 Drawing Sheets

COOLING APPARATUS

FIELD AND BACKGROUND OF THE INVENTION

The invention relates to a cooling apparatus operated by ambient air and an agent to be cooled which can have solid state at atmospherical temperatures, which comprises a housing such as a cooling tower or the like having air inlets and air closure means at the air inlets and large surface heat exchangers arranged within the cooling tower at the air inlets. With the aid of the apparatus, the agent is cooled by air streaming through the large surface heat exchanger which is divided into groups or sectors connected parallel to each other.

It is well known that in the operation of various industries large quantities of heat must be dissipated into the ambient air with the aid of the previously described cooling apparatuses, especially in the operation of thermal power stations. In the cooling apparatus, the agent to be cooled being in liquid or in gaseous state streams through large surface heat exchangers which are close-ribbed and the air flows through the heat exchanger either in a forced way (by ventilators) or by natural draft utilizing the lower density of the warm air in a chimney.

The operation of these cooling apparatuses is relatively simple in the case of fair weather. But, if the weather is cold and the agent to be cooled can change its aggregate for having solid state upon the impact of cold weather, the starting and stopping of these cooling apparatuses may run into serious difficulties which may even cause changes.

SUMMARY AND OBJECTS OF THE INVENTION

The main object of the present invention is to eliminate the aforesaid difficulties occuring with the conventional cooling apparatuses and to provide a cooling apparatus which can be operated also in cold weather without the danger of freezing up of the agent to be cooled within the heat exchanger and of interrupting the flow of the agent in the tubes of the heat exchanger.

According to the improvement in this invention, at least one pre-heating heat exchanger is provided in the air space of each sector of the large surface heat exchangers used for re-cooling the agent, and the pre-heating heat exchangers are always in parallel connection with the large surface heat exchangers of each sector.

The cooling apparatus in this invention thus enables the large surface heat exchangers to be filled up or emtied even in cold weather without the danger of damages resulting from freezing the agent to be cooled.

Preferably, the pre-heating exchanger is arranged in a housing in the air space of the large surface heat exchanger and this housing may have air closure means at at least one air opening of the housing.

In another preferred embodiment of this invention, an air transporting means such as a ventilator may be provided in the housing of the pre-heating heat exchanger, and the air closure means of the housing may be arranged at the suction side of the ventilator.

In another embodiment, the air space of the sectors is limited at its air outlet side partly by a wall of the housing of the pre-heating heat exchanger and partly by an auxiliary air closure means.

Alternatively, a heating means can be arranged between the air inlet of the housing of the pre-heating heat exchanger and the pre-heating heat exchanger itself, and the heating means is supplied with the heating energy which is independent from the great surface heat exchanger and/or from the pre-heating heat exchanger.

In another preferred embodiment, the air space of the mentioned heating means can be separated from the air space of the pre-heating heat exchanger by a partion wall which formes, with a part of the wall of the housing of the pre-heating heat exchanger, a channel circumventing the air space of the pre-heating heat exchanger, one end of which can be provided with air closure means. In this case, the ventilator can be arranged in the common air space of the heating means and the pre-heating heat exchanger.

In another preferred embodiment of the cooling apparatus of this invention, a water distributor system for humidifying the outer surface of the pre-heating heat exchangers can be provided in the housing of the pre-heating heat exchangers. In addition the water distributor system can comprise a plurality of nozzles fed by a pump from a container arranged below the pre-heating heat exchangers for collecting the water falling down from the heat exchangers as well as a valve controlling the water level within the container and an emptying conduit connected to the container.

As is usual with such kind of cooling apparatuses, shut-off means and valves are provided on suitable places and in sufficient numbers in the whole apparatus. However, in a preferred embodiment, a shut-off valve driven with an actuator can be provided in the supply conduit of every pre-heating heat exchanger and the actuators can operatively be connected to a control unit for operating them in dependency on the temperatures in a return conduit of the large surface heat exchangers and in a return conduit of the pre-heating heat exchanger. With this, the pass-through cross section of the valves are controlled for minimizing the difference between the temperatures in the return conduit of the large surface heat exchangers and the return conduit of the pre-heating heat exchanger.

BRIEF DESCRIPTION OF THE DRAWINGS

Further details will be described by making reference to the accompanying drawings which show, by way of example, various embodiments of the cooling apparatus according to the invention. In the drawings.

DESCRIPTION OF THE PREFERRED EMBODIMENTS

Figure 1:
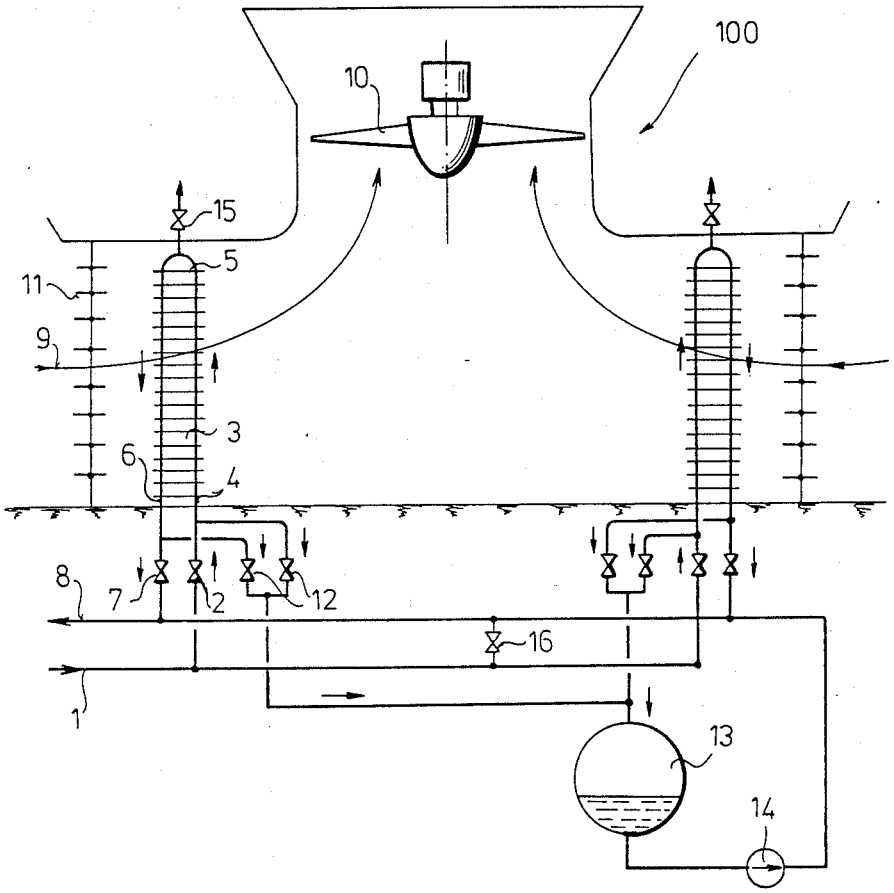
FIG. 1 is a schematic diagram of a conventional cooling apparatus.

The schematic connection diagram of a conventional cooling apparatus is represented in FIG. 1. In this example, an indirect cooling tower 100 with artificial draught having water as an agent to be cooled is shown. Of course, other types of cooling apparatuses can find utilization in connection with this invention.

Warmed water to be recooled arrives through a supply conduit 1 and a shut off valve 2 into a heat exchanger 3 having a large surface on the air side because of the plurality of fins or ribs fixed to the tubes of the heat exchanger 3. The water rises in the tubes into an upper water chamber 5 and further descends through tubes 6 and a shut off valve 7 into collecting line or a return conduit 8. Resulting from the enlarged surface of the heat exchanger 3, the heat exchange on the air side of it is very intensive.

Large surface heat exchangers 3 are arranged in a housing, in this example in the cooling tower 100 forming a circle in the vincinity of air inlets of the cooling tower 100. More of the neighboring heat exchangers 3 are connected in parallel to each other for forming groups or sectors. These sectors are connected to supply conduit 1 and to return conduit 8 by a common shut-off valve 2 and 7, respectively. As it is usual in the practice, six to eight sectors are in a cooling tower and each sector contains twenty to fifty heat exchangers 3 connected parallel to one another.

Through the heat exchanger 3, is air flowing as indicated by arrow 9. As mentioned above, artificial draught is used in this embodiment and which is caused by a ventilator 10 arranged in cooling tower 100, e.g. in its upper chimney portion. As a result of the air draught, the water will be recooled. The intensity of the draught can be controlled by air closure means such as louvres 11 at the air inlets of cooling tower 100.

In operational interrupts, all sectors of large surface heat exchangers 3 must be emptied through branched out valves 12. The drained water is let into a container 13. If the cooling tower 100 is to be started again, heat exchangers 3 must be filled up with water which will be supplied from container 13 by a pump 14.

To upper water chamber 5 of heat exchangers 3, an air escape and an inlet valve 15 is connected. Also, a valve 16 is provided between supply conduit 1 and return conduit 8 for permitting shutting off heat exchangers 3, also.

Not only are the heat exchangers close-ribbed but, also for better heat exchange, their tubes have small diameters and, thus, their inner water volume is small. Consequently, the mass of the metallic material of heat exchangers 3 is five to twenty times greater than the mass of the water contained in the heat exchangers 3, thus, the material of the heat exchangers has a huge heat storage capacity in relation to the heat storage capacity of the water contained in it. But, in the operational interrupts, the heat exchangers cool-off to the ambient air temperature and, what's more, within a very short time because of the large surface on the air side. Nevertheless, heat exchangers 3 have been built as high as 15 to 20 meters, thus, also in the case of closed louvres 11, a considerable air flow cools the air side of the heat exchangers 3. For a higher efficiency of the heat exchange, the flow resistance to the air stream is low.

The conventional cooling towers as described above can be safely started, stopped and restarted with ambient temperatures not smaller than 5 to 8 degrees centigrade below zero. However, with colder ambient climates, the danger of deformations, demolition or even rupture of the heat exchangers 3 have to be taken into consideration because of freezing up of the water and/or of temperature stresses. In the course of filling up the heat exchangers 3, valves 2 and 7 are opened simultaneously, thus, the water flows from conduits 1 and 8 into the sectors and heat exchangers 3 and the air escapes through valve 15. In the course of this, the water streams upwards on the forward side and on the return side through tubes with relatively small diameters. Because of the reasons mentioned above, the metallic material of the heat exchangers 3 dissipates such an amount of heat from the water, that it freezes up partly or totally. The ice plugs close the tubes, and, thus, the water circulation is prevented. At the same time, the air flow of the natural draught even with closed louvres 11 is an important expedient factor of further cooling the water in the tubes of the heat exchangers 3, thus, the water standing still in heat exchangers 3 freezes in a quite short time and burst the tubes.

In order to lessen the effect of these factors, it has been suggested to warm up the heat exchangers either by using warm water for filling up or by pumping hot air on the entrance air side of the heat exchanger. However, both of these methods increased the temperature stresses within the material of the heat exchangers. In the case of filling up with warm water, the colder is the weather, the hotter water is to be used. In the case of warm air blown onto the heat exchanger surface, the hot air having lower density, streams upwards, and the heat exchanger 3 will be hot in the upper regions and it remains cold at the bottom regions. If the water filled in does not freeze in these lower regions, it cools off very much and then, it comes into contact with the hot heat exchanger surfaces. The large temperature differences cause permanent deformations, ruptures and, finally, lead to the destruction of the heat exchanger.

For warming up the air as mentioned above, an auxiliary heat source such as hot air generator operated with electrical energy or with oil is usually provided in a space portion 18 between the heat exchangers 3 and the louvres 11. They have a considerable energy demand which has to be supplied to the cooling towers. This is often difficult if not impossible and expensive.

Furthermore it is disadvantagegous for both of the methods discussed above that they are quite time consuming and, therefore, the starting of the cooling towers is slower than that of the other apparatuses of the power plant such as the oven or the steam turbine.

When emptying the heat exchangers, also the danger of freezing has to be taken into consideration. Valves 2 and 7 will be closed and valve 12 opened. From a heat exchanger 3 with avarage measurements, the water flows out in 30 to 50 seconds. Since the metallic parts of the heat exchangers 3 have a higher temperature than the ambient air, a natural draught is present also after the emptying for a certain period of time. Because of the strong cooling effect, the water remaining on the inner surface of the heat exchanger 3 becomes frozen and it forms ice plugs which close the path of the water flow at the next starting of the heat exchangers.

Figure 2:
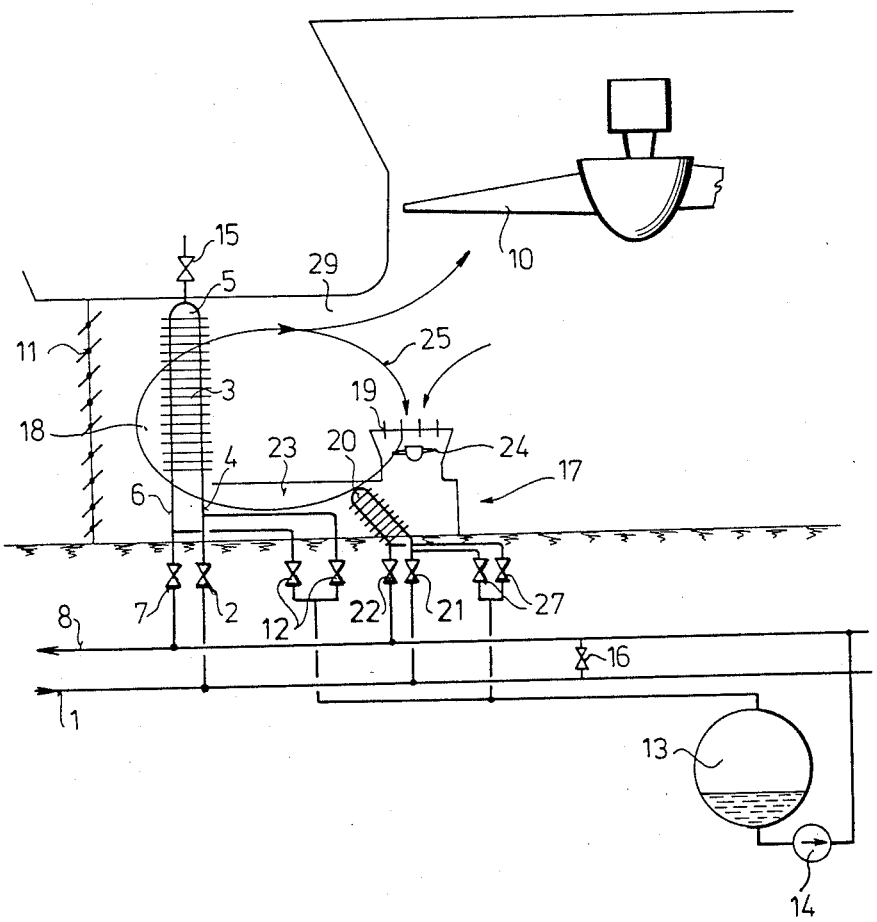
FIGS. 2 and 3 show the schematic diagrams of an embodiment of this invention in two operational positions.
Figure 3:
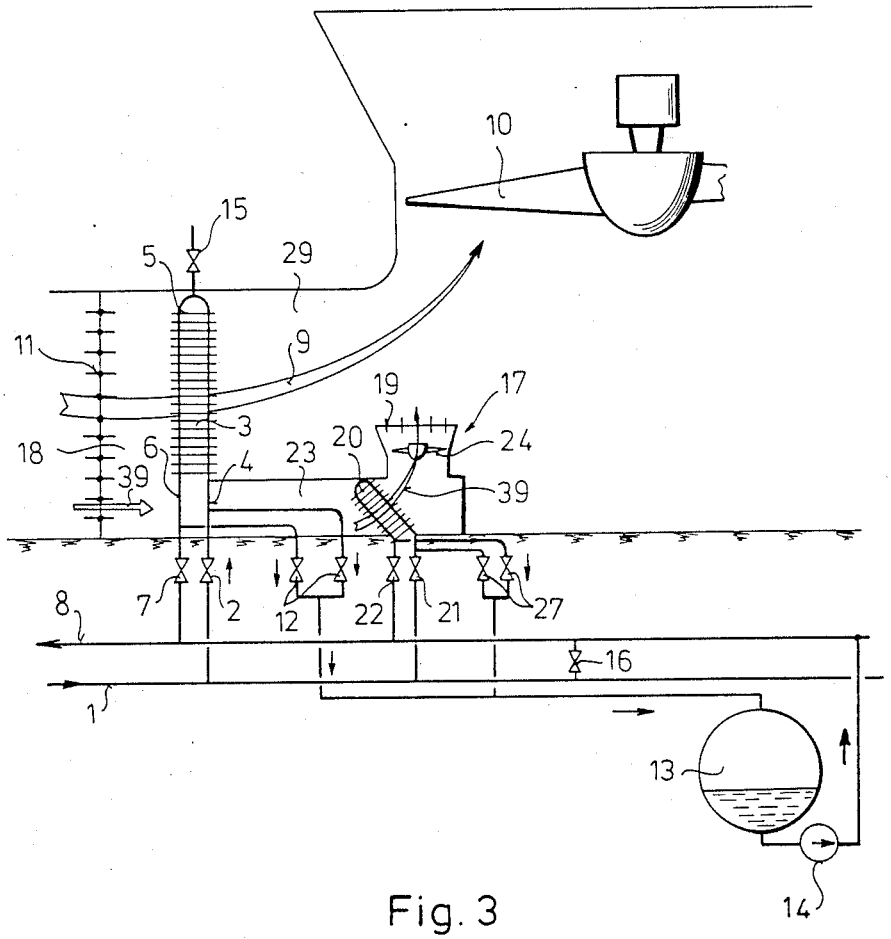
Figure 4:
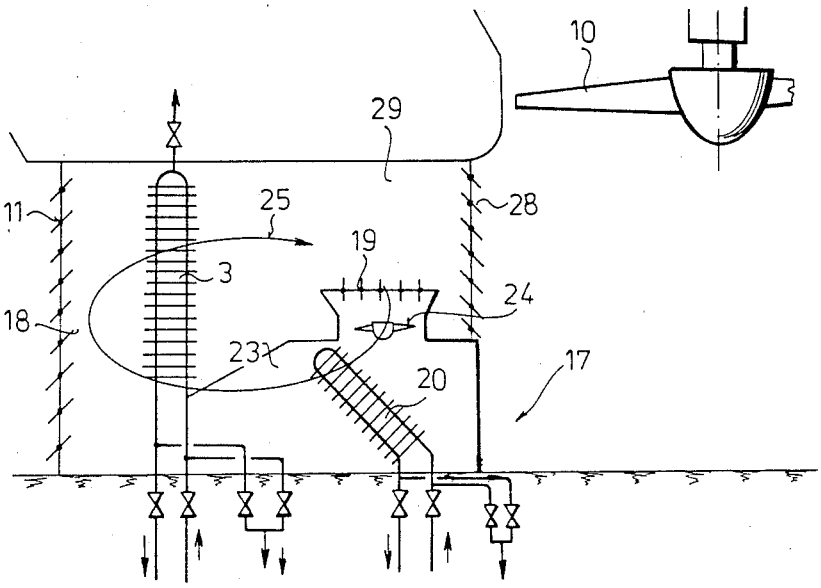
FIGS. 4 to 7 are connection diagrams of further exemplified embodiments according to this invention.

In contrast to this, in an embodiment of the cooling apparatus according to the present invention, as shown in FIGS. 2 and 3 at least one pre-heating heat exchanger 20 is provided in the air space 29 of each sector of heat exchangers 3 and which is connected through valves 21 and 22 to supply conduit 1 and return conduit 8, respectively. In this way, pre-heating heat exchangers 20 are in parallel connection with heat exchangers 3. Emptying valves 27 are also provided for pre-heating heat exchanger 20.

Pre-heating heat exchanger 20 in FIG. 2 is arranged in a housing 17 which is in the air space 29 of the large surface heat exchangers 3. At the air inlet of this housing 17, an air closing means such as louvres 19 and in the vincinity, within housing 17, an air forcing means such as a ventilator 24, is arranged. The other opening of housing 17 is connected to the air space portion 18 between heat exchangers 3 and louvres 11.

The tubes of pre-heating heat exchanger 20 are considerably shorter than that of the large surface heat exchangers 3. The longitudinal measurements and the metal weight of pre-heating exchangers 20 are chosen to be small, e.g. they are three times to four times smaller than that of the heat exchangers 3. The heating energy is communicated by the water to be recooled which is circulated in conduits 1 and 8.

After starting the turbine, pre-heating heat exchanger 20 can be connected to the cooling circuit when the water reaches a temperature of 10 to 15 degrees centigrade. Heat exchangers 20 can be filled up without any danger of freezing, since their tubes are relatively short and they are arranged within air chamber 23 of housing 17 and, now, louvres 19 are closed, thus, there is practically no air streaming which could cool them.

After the pre-heating heat exchangers 20 are filled up and the circulation within this pre-heating circuits is established, the warming up of sectors of the large surface heat exchangers 3 can start. For this, louvres 19 will be opened and ventilator 24 is started up to suck air through louvres 19 and to press it thorough pre-heating heat exchanger 20 into air space portion 18. Thereafter, the warm air will flow through heat exchanger 3 and the latter will be warmed up. Further, the air can be sucked back into air chamber 23 by ventilator 24 as indicated by an arrow 25.

With this, a great amount of air is warmed up and is used for pre-heating heat exchangers 3. The temperature of this air is relatively low, it is e.g. between 5 to 15 degrees centigrade. Therefore, it won't stream up to the upper regions of heat exchanger 3 but it will contact also the lower regions. These air temperatures are sufficient to warm up the large surface heat exchangers 3 to several degrees above freezing point. For the large amount of air, heat exchangers 3 mean a considerable flow resistance, thus, the air will be evenly distributed along the whole surface of the heat exchangers 3.

When the temperature of heat exchangers 3 reaches 5 to 10 degrees centigrade above freezing point, their filling up procedure can be started as described above. After heat exchangers 3 through conduits 1 and 8 and valves 2 and 7 have been filled up and the water circulation therein has been established, ventilator 10 of cooling tower 100 can be started and louvres 11 of cooling tower 100 can gradually be opened for increasing the recooling effect.

In cold weather, heat exchangers 3 can be stopped (emptied) as follows:

If only one sector of heat exchangers 3 has to be stopped, then louvres 11 are first closed and ventilator 24 in housing 17 is started for pressing air into air portion 18. Thereafter, valves 2 and 7 of heat exchangers 3 are closed and emptying valve 12 is opened. Now, the water flows out from the tubes of heat exchanger 3. In this period and in 10 to 15 minutes after this, ventilator 24 forces warm air through the large surface heat exchanger 3, and the freezing of the water is prevented. Thereafter, ventilator 24 can be stopped and pre-heating heat exchanger 20 can be emptied by closing valves 21 and 22 and opening valve 27.

In the case of shorter operational interrupts, the emptying of pre-heating heat exchangers 20 is not necessary and, thus, the repeated starting of heat exchangers 3 can be quicker.

As it is mentioned above, housing 17 is connected to air space portion 18 between louvres 11 and the large surface heat exchangers 3. At full load of the cooling apparatus, pre-heating heat exchangers 20 can also be used for cooling purposes as shown in FIG. 3. The main stream of air flows through the large surface heat exchanger 3 as indicated by arrow 9 by an auxiliar air flow can be established through air chamber 23 and heat exchanger 20 as shown by arrows 39. This air flow can be promoted by ventilator 24 driven for sucking air through air chamber 23. Thus, it is preferable to use a ventilator 24 with reversable rotational direction.

When the climate with which the cooling tower 100 is used, is extremely cold, an air closing means such as louvres can be provided for closing up the air space of each sector of the large surface heat exchangers 3 towards the chimney portion of cooling tower 100. During the filling up operation of heat exchangers 3, both louvres 11 and 19 limiting the air space of the sector from both sides are closed and the air pre-heating the large surface heat exchangers 3 are recirculated within the air space of the sector. With this, the temperature of heat exchanger 3 necessary for starting it in the cold weather can be reached faster, since the heat loss is smaller and the distribution of warm air along heat exchanger 3 is more even.

Figure 5:
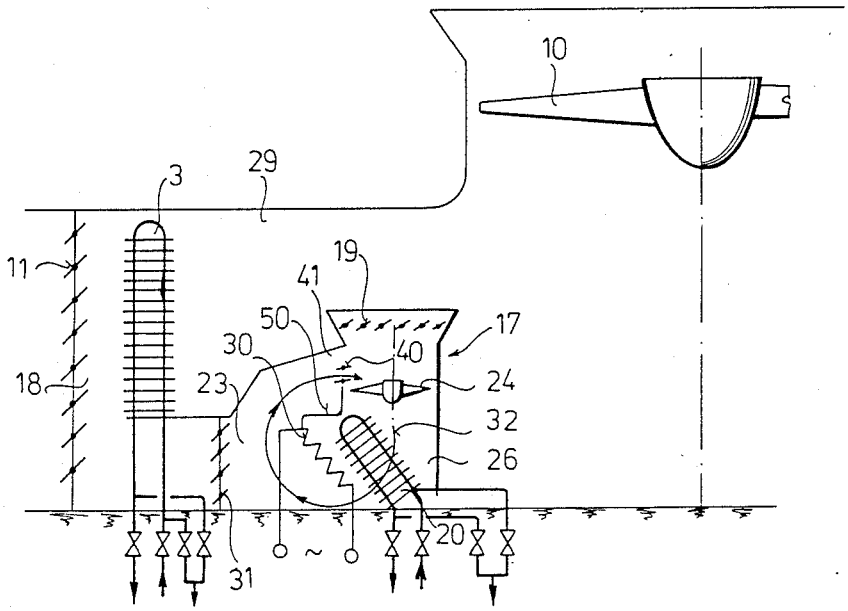

In FIG. 5, an embodiment of this invention having two stages of pre-heating is shown. Therefore, an inner circle of air circulation is established within housing 17 as shown by an arrow 32 in which a heating means, such as an electrical heater 30, is provided. It is important that the heating means should be supplied from an energy source independent from the water to be recooled. An air space 26 of electrical heater 30 and pre-heating heat exchanger 20 is separated from air chamber 23 of housing 17 by a partition wall 50 which forms a chanel 41 closable by e.g. louvres 40. Ventilator 24 is arranged within air space 26 which can be closed by e.g. louvres 31 at its opening towards air space portion 18. With this, the inner air circulation according to arrow 32 can be established with which heat exchanger 20 can be preheated in extremely cold weather, e.g. below −50 degrees centigrade.

When starting the filling up operation at temperatures below −50 degrees centigrade, first all louvres 11, 19, 31 and 40 are closed and electrical heater 30 is energized. When a temperature of −15 to −20 degrees centigrade is reached within air space 26, louvres 40 are opened and ventilator 24 is switched on for pressing air through heat exchanger 20 and heater 30. With this, the inner circulation as shown by arrow 32 will be established. When finally a temperature of 5 to 15 degrees centigrade above zero is reached in air chamber 23, pre-heating heat exchanger 20 can be filled up with water and the filling up operation of the large surface heat exchangers 3 can be continued as usual.

Figure 6:
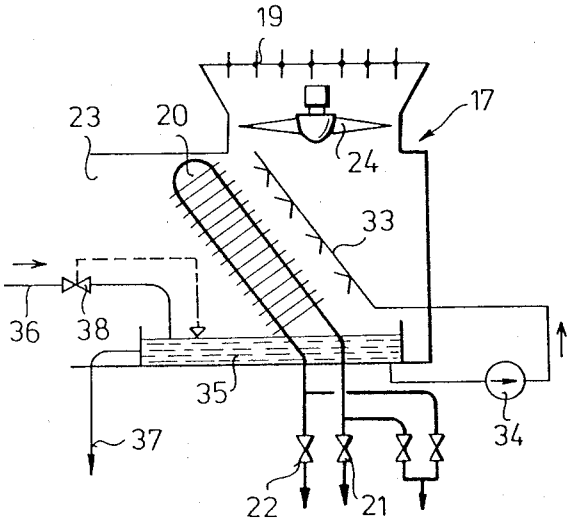

As mentioned previously, pre-heating heat exchangers 20 can also perform the recooling function of cooling tower 100 if it is necessary in hot weather. The heat transmissing capacity of these heat exchangers 20 can be enlarged when their surface will be humidified and with this, at least partially, evaporation cooling is realized. An embodiment of the invention for these purposes is illustrated in FIG. 6. Therein, a water distributor system is provided having a plurality of water spray nozzles 33 fed by a pump 34. Below heat exchanger 20, a container 35 collecting the water dropping from heat exchanger 20 is arranged to which pump 34 is connected. The water evaporating from the surface of heat exchanger 20 is made up through a conduit 36 having a valve 38 controlling the water level within container 35. The thickened water is let out through a conduit 37.

With the help of this embodiment, the cooling efficiency of heat exchangers 20 can be enlarged to two to three times of that of the embodiment without water distributor system depending on the humidity content of the ambient air. With this, heat exchangers 20 having relatively small heat exchange surfaces can supply 20 to 30 percent of the whole cooling capacity of cooling tower 100 in summer time.

Pre-heating heat exchangers 20 as described above have relatively short tubes with relatively large diameters in order to have low flow resistance on the water side. Therefore, the special water forwarding capacity of heat exchangers 20 are much greater than that of the large surface heat exchanger 3. For filling and emptying the heat exchangers 3, this feature is advantageous as described above. However, in the summer, in warm weather, the large water forwarding capacity of heat exchangers 20 are not so advantageous since in their cooling function in that time, the water streaming through them can not be sufficiently recooled and the water leaving them will be warmer than the water recooled in the large surface heat exchangers 3 connected parallel to heat exchangers 20. For increasing the thermodynamic efficiency of the apparatus in this invention, the water delivered through supply conduit 1 should be recooled to the same extent in both of the pre-heating heat exchangers 20 and in the large surface heat exchangers 3. For the realization of this feature, an embodiment is shown in FIG. 7.

Figure 7:
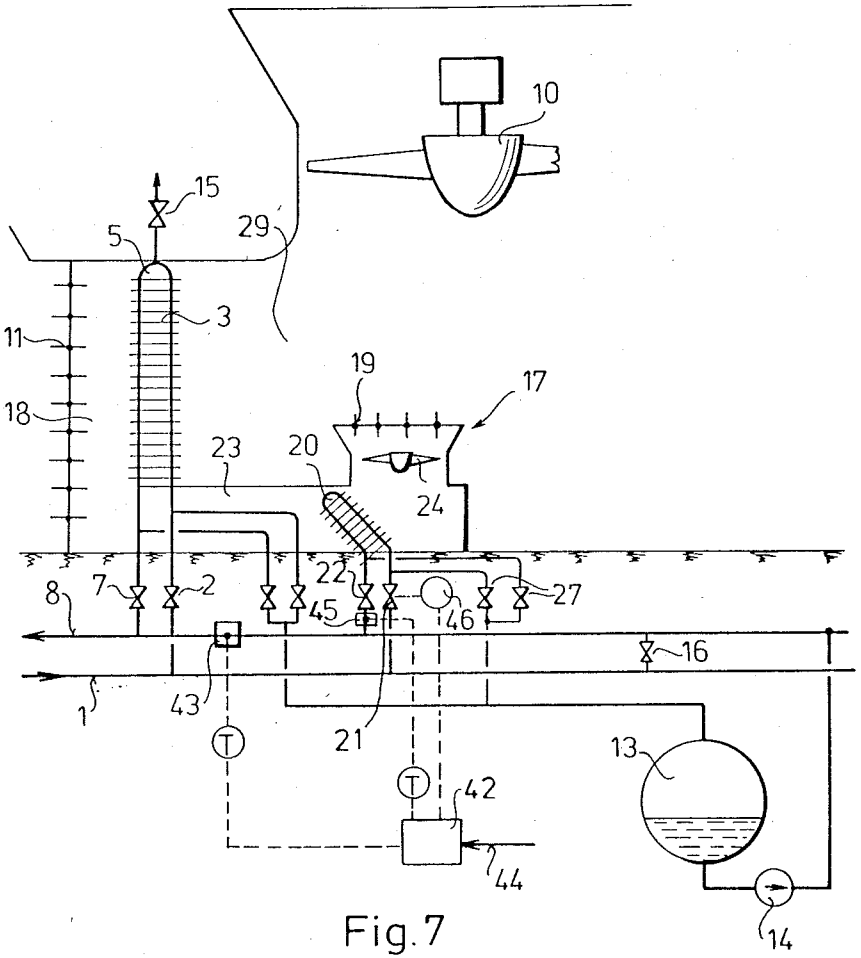

In the exemplified connection diagram in FIG. 7, valves 21 connecting pre-heating heat exchangers 20 to supply conduit 1 are remote controlled, for the purpose of which an actuator 46 is attached to each valve 21. Actuators 46 are operatively connected to a control unit 42 for operating them in dependency from the water temperature in the return conduit 8 as well as in the return conduit of pre-heating heat exchanger 20 after valve 22. For this, a temperature indicator 43 is provided in return conduit 8 and another temperature indicator 45 is arranged in the return conduit of heat exchanger 20 between its junction to return conduit 8 and valve 22.

By an input signal 44, the required operating mode is given by a central control unit of the power plant or by a hand switch with which the pre-heating operation or cooling operation in the summer are chosen. In the case of pre-heating operation mode, valve 21 will be entirely opened by actuator 46 driven with a signal received from control unit 42. When, according to input signal 44, cooling operation is required, valve 21 will be closed by actuator 46 until the temperature in the return conduit of heat exchanger 20 on indicator 45 will be the same as in return conduit 8 on indicator 43. The signals delivered by indicators 43 and 45 are compared in control unit 42 and in dependence on this comparison, actuator 46 will be driven by the signals of control unit 42.

In another embodiment, indicators 43, 45 and control unit 42 can be substituted by a three-way valve 21 in the supply conduit of pre-heating heat exchangers 20. In pre-heating operation, three-way valve 21 is entirely opened, during the summer in cooling operation it is partially opened and during operational interrupts of the cooling tower 100, it is entirely closed by actuator 46.

We claim:

1. Cooling apparatus operated by ambient air and an agent to be cooled which can have solid state at cold atmospherical temperatures, comprising a cooling tower housing with air inlets and air closure means at the air inlet and large surface heat exchangers arranged within the cooling tower at the air inlets and divided into groups or sectors in parallel connection and with which the agent is cooled by air streaming through the large surface heat exchangers, at least one pre-heating heat exchanger of smaller size (20) arranged in the air space (29) of each sector, the pre-heating heat exchangers (20) being in parallel connection with the large surface heat exchangers (3) of the sector, and means to recirculate air from the pre-heating heat exchangers to the large surface heat exchangers.

2. A cooling apparatus as claimed in claim 1, wherein the pre-heating heat exchanger (20) is arranged in a housing (17) being in the air space (29) of the large surface heat exchanger (3) and the housing (17) has air closure means at at least one air opening of the housing (17).

3. A cooling apparatus as claimed in claim 2, wherein an air transporting means such as a ventillator (24) is provided in the housing (17) of the pre-heating heat exchanger (20) and the air closure means of the housing (17) is arranged at the suction side of the ventillator (24).

4. A cooling apparatus as claimed in claim 2, wherein the air space (29) of each sector is limited at its air outlet partially by a wall of the housing (17) of the pre-heating heat exchanger (20) and partly by an auxiliary air closure means.

5. A cooling apparatus as claimed in claim 2, wherein a heating means is arranged between the air inlet of the housing (17) of the pre-heating heat exchanger (20) and the pre-heating heat exchanger (20) and the heating means is supplied with heating energy independently from the large surface heat eschangers (3) or from the pre-heating heat exchangers (20).

6. A cooling apparatus as claimed in claim 5, wherein an air space (26) of the heating means and the pre-heating heat exchanger (20) is separated from the inner air chamber (23) of the housing (17) of the pre-heating heat exchanger (20) by a partition wall (50) and between the partition wall (50) and a part of the wall of the housing (17) a channel (41) is formed circumventing the air space (26) of the heating means and the pre-heating heat exchanger (20), one end of which being provided with an air closure means, and the ventilator (24) is arranged in the air space (26) of the heating means and the pre-heating heat exchanger (20).

7. A cooling apparatus as claimed in claim 2, wherein a water distributor system for humidifying the outer surface of the pre-heating heat exchangers (20) is provided in the housing (17) of the pre-heating heat exchangers (20).

8. A cooling apparatus as claimed in claim 7, wherein the water distributor system comprises a plurality of nozzles (23) fed by a pump (34) from a container (35) arranged below the pre-heating heat exchanger (20) for collecting the water dripping down as well as a valve (38) controlling the water level within the container (35) and an emptiying conduit (37) connected to the container (35).

9. A cooling apparatus as claimed in claim 1, wherein a shut off valve (21) driven with an actuator (46) is provided in the supply conduit of each of said pre-heating heat exchangers (20) and the actuators (46) are operatively connected to a control unit (42) for operation in dependency from the temperature in the return conduit (8) of the large surface heat exchangers (3) and from the temperature in a return conduit of the pre-heating heat exchanger (20).

10. A cooling apparatus as claimed in claim 9, wherein the pass through cross-section of the shut off valve (21) is controlled by the control unit (42) for minimizing the difference between the temperatures in the return conduit (8) of the large surface heat exchangers (3) and the return conduit of the pre-heating heat exchanger (20).

* * * * *